US009713355B2

(12) United States Patent
Daoust

(10) Patent No.: US 9,713,355 B2
(45) Date of Patent: Jul. 25, 2017

(54) MECHANICAL FASTENERS FOR SHOCK-ABSORBING HELMETS

(75) Inventor: Bernard Daoust, Sutton (CA)

(73) Assignee: XENITH, LLC, Lowell, MA (US)

( * ) Notice: Subject to any disclaimer, the term of this patent is extended or adjusted under 35 U.S.C. 154(b) by 0 days.

(21) Appl. No.: 13/150,867

(22) Filed: Jun. 1, 2011

(65) Prior Publication Data

US 2012/0304366 A1 Dec. 6, 2012

(51) Int. Cl.

*A42B 3/10* (2006.01)
*A42B 3/12* (2006.01)
*A42B 3/14* (2006.01)

(52) U.S. Cl.

CPC ..... *A42B 3/10* (2013.01); *A42B 3/12* (2013.01); *A42B 3/127* (2013.01); *A42B 3/147* (2013.01)

(58) Field of Classification Search

CPC ..... A42B 2/10; A42B 2/125; A42B 2/127; A42B 3/10; A42B 3/12; A42B 3/127; A42B 3/147; A42B 3/124; A42B 3/125; A42B 3/14; A42B 3/142; A42B 3/145

USPC ..... 2/9, 10, 410–416, 417, 419, 420

See application file for complete search history.

(56) References Cited

U.S. PATENT DOCUMENTS 2,967,304 A * 1/1961 Austin ..... 2/417
3,040,329 A * 6/1962 Ruggiero ..... A42B 3/14 2/416
3,192,536 A * 7/1965 Benner ..... A42B 3/14 2/418
3,555,560 A * 1/1971 Rascke ..... A42B 3/14 2/416
3,609,764 A * 10/1971 Morgan ..... 2/414
3,713,640 A * 1/1973 Margan ..... 267/117
3,806,950 A * 4/1974 Spencer-Foote ..... 2/413
3,843,970 A * 10/1974 Marietta et al. ..... 2/415
3,849,801 A * 11/1974 Holt et al. ..... 2/413
3,994,022 A 11/1976 Villari
4,035,846 A * 7/1977 Jencks ..... 2/413
4,055,860 A * 11/1977 King ..... A42B 3/14 2/416
4,831,668 A * 5/1989 Schulz ..... 2/414
4,888,831 A * 12/1989 Oleson ..... A42B 3/145 2/420
4,916,759 A 4/1990 Arai
5,035,009 A * 7/1991 Wingo et al. ..... 2/414
5,930,840 A * 8/1999 Arai ..... 2/411
5,937,446 A 8/1999 Fallert
6,081,931 A * 7/2000 Burns ..... A42B 3/14 2/411
6,934,971 B2 * 8/2005 Ide et al. ..... 2/425
6,986,169 B2 1/2006 Nakamura
7,509,835 B2 3/2009 Beck
7,600,513 B2 * 10/2009 Gunaratnam ..... A61M 16/06 128/205.25
7,607,179 B2 10/2009 Shih
7,673,351 B2 * 3/2010 Copeland et al. ..... 2/425
7,841,026 B2 11/2010 Makris et al.
8,201,269 B2 * 6/2012 Maddux et al. ..... 2/9
2007/0266481 A1 11/2007 Alexander et al.
2010/0269246 A1 10/2010 Salomon

* cited by examiner

*Primary Examiner* — Amy Vanatta
(74) *Attorney, Agent, or Firm* — Morgan, Lewis & Bockius LLP

(57) ABSTRACT

Shock-absorbing helmet liners may be releasably locked to helmet shells using mechanical fasteners.

16 Claims, 7 Drawing Sheets

MECHANICAL FASTENERS FOR SHOCK-ABSORBING HELMETS

TECHNICAL FIELD

The present invention relates generally to shock-absorbing helmets, and in particular to means for fastening an interior liner to an exterior helmet shell.

BACKGROUND

Protective helmets are widely used during athletic, industrial, and military activities (including, e.g., sports, motorcycling, construction work, and combat) to provide protection to the wearer's head in case of an impact or collision. For example, football and baseball players routinely wear helmets to reduce the effect of impact forces and diminish the risk of concussions or other head injuries. Protective helmets often include a rigid or semi-rigid exterior shell, e.g., made of a hard plastic material, for distributing impact forces over a wider area, and an interior liner for contact with the wearer's head. Located between the liner and the shell, or integrated with either, is usually a crushable, impact-absorbing layer (such as, e.g., a layer of foam or an arrangement of shock-absorbing fluid-dynamic cells) designed to eliminate or reduce the force of the impact on the wearer's head.

In many helmet designs, the liner, shock-absorbing layer, and/or shell are glued together or otherwise permanently adhesively affixed to each other across large surface portions, e.g., with a layer of VELCRO hook-and-loop fastener (or similar mechanical adhesive). Alternatively, in some helmets, the liner is screwed to the shell at the periphery. These conventional approaches to securing helmet liners are, generally, inconveniently practiced. The attachment of the liner with screws is tool-based, and the use of VELCRO can make correct placement of the liner into the shell difficult and corrections inconvenient. In addition, the hardware or adhesive layer required to attach the shell to the liner adds material and manufacturing cost to the helmet. Accordingly, secure and low-cost alternative helmet-liner attachment means would be desirable.

SUMMARY

The present invention relates, in general, to mechanical fasteners for releasably affixing a protective helmet shell to a shock-absorbing liner inserted therein. These mechanical fasteners allow the liner to be locked securely, but releasably, to the shell interior. For example, in some embodiments, the fasteners are engaged by hand into a locked configuration and, similarly, released by hand. Compared with screw attachment of the liner and shell, which requires special tools for separating the shell and liner, a hand-releasable mechanism facilitates easier exchange or replacement of the liner, e.g., to combine one shell with any of a plurality of liners (or vice versa), depending on the application, or to replace a worn-out liner. A "mechanical fastener," as used herein, denotes any hand-operable mechanical arrangement utilizing complementary interlocking (e.g., mating) components and adapted to releasably join two parts (such as the shell and liner of a helmet). Mechanical fasteners include, for example, a clasp, clamp, buckle, clip, hook, tab, or a component of such or a similar device. A "mechanical fastener" is not meant to include adhesives like VELCRO that exploit mechanical interlocking at a microscopic scale. By "hand-operable" is meant engageable and releasable by hand without tools. Accordingly, the term "mechanical fastener" does not include screws or other tool-requiring affixation devices.

In some embodiments, the mechanical fasteners are integrated into the liner. For example, the liner and fasteners may be made from a polymer material and molded in one piece. Alternatively, a standard mechanical (e.g., spring-loaded) fastener may be affixed to the liner by means of a short strap. The fasteners of the liner may engage with complementary features of the shell interior, such as molded loops that project from the interior surface of the shell. Advantageously, these projections may be molded into the shell at the same time as the shell is molded, reducing manufacturing cost. In various embodiments, the fasteners are arranged only around a periphery of the liner, allowing the liner to move relative to the shell, which improves dissipation of rotational forces. In some embodiments, the fasteners are located such that the overall thickness of the helmet is reduced as compared with a helmet of equal ride-down distance (i.e., distance over which impact forces are absorbed) that utilizes conventional attachment means (such as VELCRO). This allows the thickness of the shock-absorbing layer, and thus the ride-down distance, to be increased without increasing the overall helmet size.

Accordingly, in one aspect, the invention is directed to a shock-absorbing helmet that includes a protective shell, a shock-absorbing liner for insertion into the interior of the protective shell, and a plurality of mechanical fasteners for releasably locking the liner to the shell interior. The mechanical fasteners may be engageable by hand into a locked configuration with respect to the shell interior and releasable by hand from the locked configuration. In some embodiments, the fasteners are engaged by complementary features of the shell interior, which may have the form of (e.g., molded) projections, such as raised bars. The fasteners may be slidably received into the complementary features and locked against them by spring action. In various embodiments, the fasteners lock the liner to the shell only along a peripheral edge.

In another aspect, the invention provides a shock-absorbing liner that is adapted for releasable affixation into an interior of a helmet shell. The liner includes mechanical fasteners for releasably locking the liner to the shell interior. As described above, the fasteners may be engageable and releasable by hand, and may engage projections protruding from an interior surface of the shell. The fasteners may be arranged along a peripheral edge of the liner, and may be molded at the same time as the remainder of the liner.

A further aspect relates to a protective helmet shell for releasably receiving a shock-absorbing liner in an interior of the shell. The shell includes, at an interior surface, multiple projections that facilitate releasably locking the liner to the shell. Each of the projections may releasably engage a mechanical fastener of the liner. The projections may include raised bars, and may be molded at the same time as the helmet shell. In various embodiments, the projections are arranged along a peripheral edge of the shell.

BRIEF DESCRIPTION OF THE DRAWINGS

The foregoing will be more readily understood from the following detailed description of the invention, in particular, when taken in conjunction with the drawings, in which.

DETAILED DESCRIPTION

Figure 1:
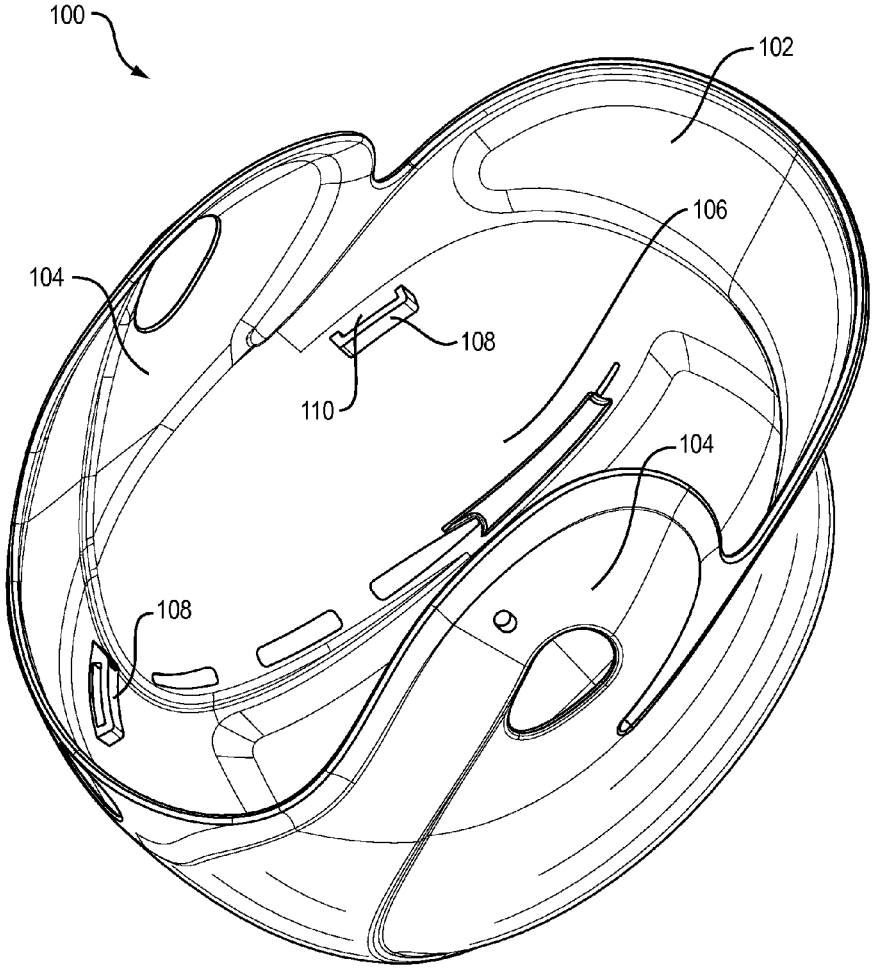
FIG. 1 is a perspective view of a helmet shell in accordance with one embodiment.

In the following description, embodiments of the present invention are described in connection with a baseball batting helmet; it should be understood, however, that the invention may be applied to any type helmet. FIG. 1 shows, largely from the underside, the outer shell 100 of a batting helmet with a brim 102 and two ear straps 104. At the periphery of the crown 106 that covers the wearer's head during use, several loops 108 protrude from the interior surface of the helmet shell 100. Each of these loop-shaped projections 108 may form a raised bar supported by side walls, leaving a slit 110 between the raised bar and the surface of the shell 100. The helmet shell 100 may be fabricated from a rigid and preferably lightweight polymer or co-polymer material, such as, e.g., polycarbonate, polyethylene, or polypropylene. Other suitable helmet shell materials include, for example, acrylonitrile butadiene styrene (ABS), high-density polyethylene (HDPE), fiberglass, or a composite material. The shell 100 may be injection-molded using processes well-known in the art. In brief, injection molding involves pouring liquid polymer into a (typically metallic) mold cavity, where the polymer cools and hardens to the configuration of the cavity. The loop-shaped projections 108 are preferably (although not necessarily) molded at the same time as the remainder of the helmet shell 100, i.e., the shell and projections 108 are fabricated in one piece.

Figure 2:
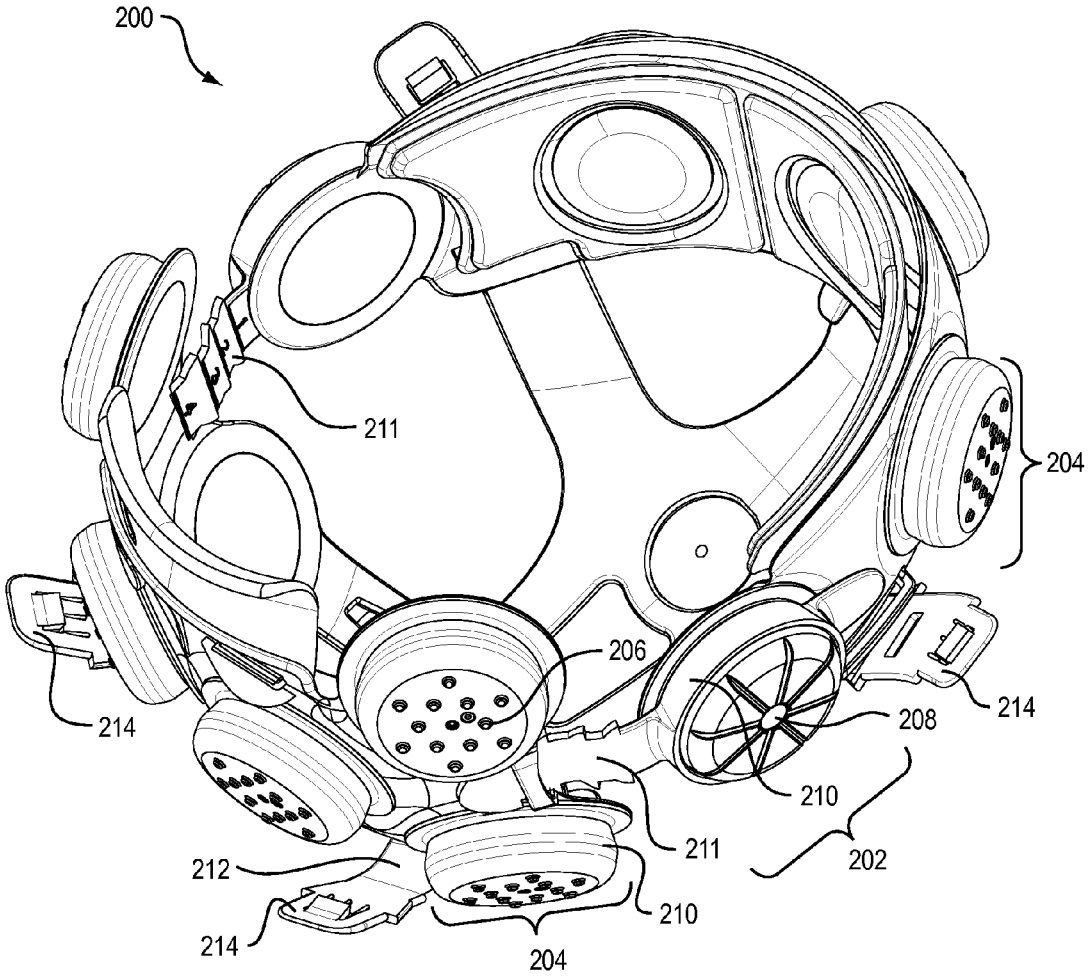
FIG. 2 is a perspective view of a helmet liner in accordance with one embodiment.

FIG. 2 illustrates a helmet liner 200 (oriented like the shell 100 of FIG. 1). The helmet liner 200 may be fabricated from a flexible or semi-flexible polymer material, such as expanded polypropylene foam, molded thermoplastic polyurethane (TPU) or a synthetic rubber, using injection molding or another technique well-known in the art. The liner 200 helps conform the helmet to the wearer's head, and provides padding between the head and the shell 100. Integrated into the liner 200 are various compression cells 202, 204 for absorbing impact forces. The compression cells 202, 204 are filled with a fluid (e.g., air) that is vented upon impact through one or more orifices 206, 208. The cell enclosures 210 may be made of a polymer material (e.g., the same material as the liner portions that provide padding), and may be shaped so as to contribute to shock absorption. For example, in certain embodiments, the walls of the compression cells resist shock forces during a first phase of the impact, and then buckle to allow the remainder of the impact to be absorbed fluidically though fluid venting and compression of the cell. Via ratchet straps 211 connected to the compression cells 202, 204, the relative positions of the cells 202, 204 and the length of the perimeter of the liner 200 may be adjusted.

Figure 3:
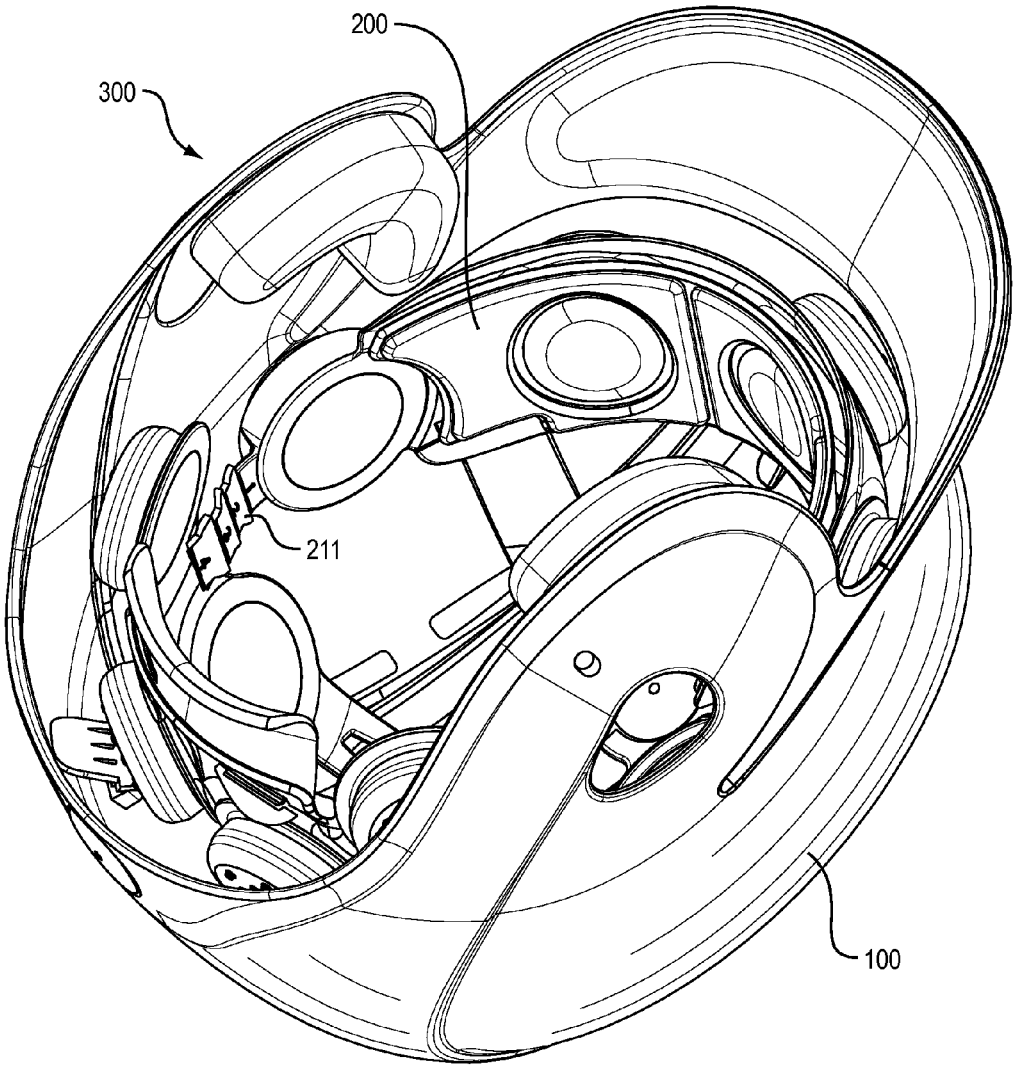
FIG. 3 is a perspective view of an assembled helmet in accordance with one embodiment.

To assemble the helmet, the liner 200 is inserted into the interior of the shell 100 (from the top in FIGS. 1 and 2); the assembled helmet 300 is depicted in FIG. 3. The liner 200 includes multiple straps 212 each terminating in a fastener 214. The straps and/or fasteners may be manufactured separately and affixed to the liner 200, or—preferably—molded simultaneously with the liner 200. Via the fasteners 214, the liner 200 can be locked securely to the shell 100, as illustrated in more detail in FIGS. 4, 5A, and 5B.

Figure 4:
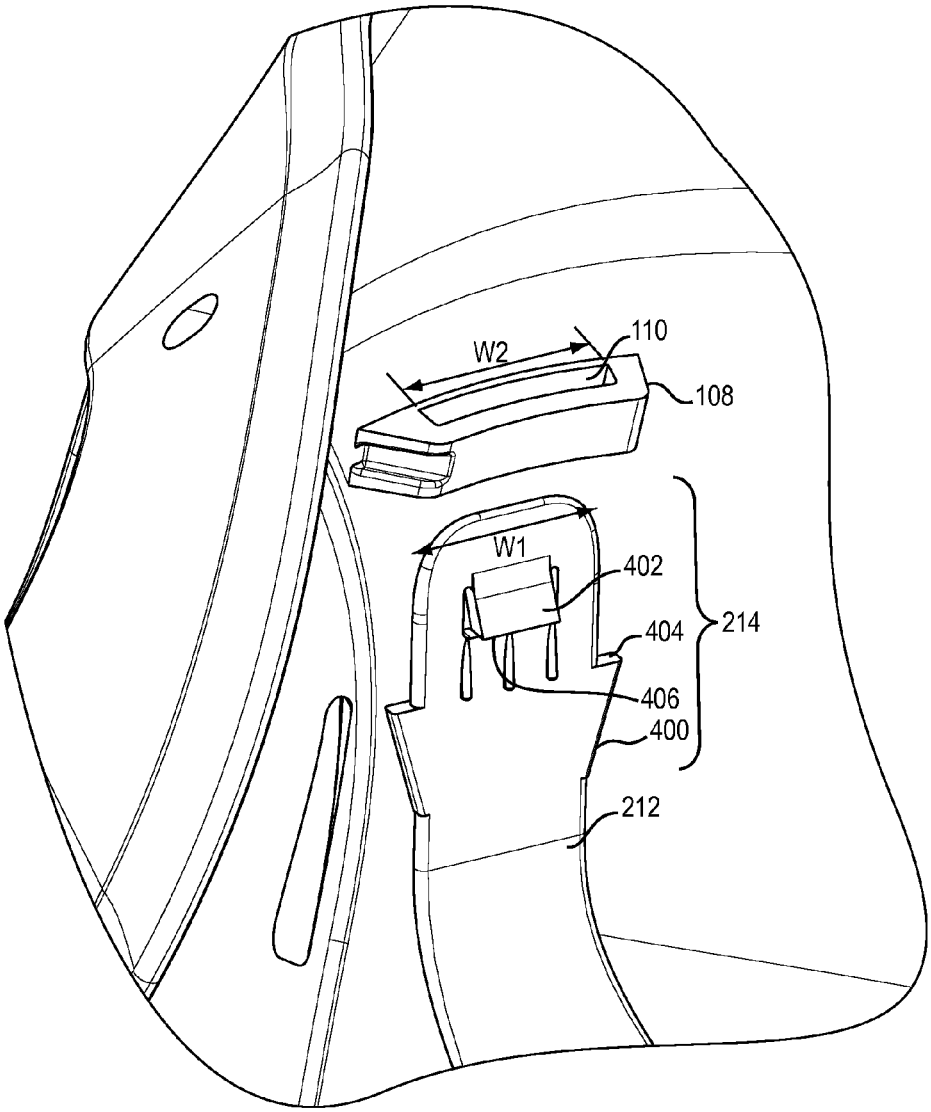
FIG. 4 is a close-up perspective view of a fastener and complementary feature of the shell in accordance with one embodiment in unengaged configuration.
Figure 5A:
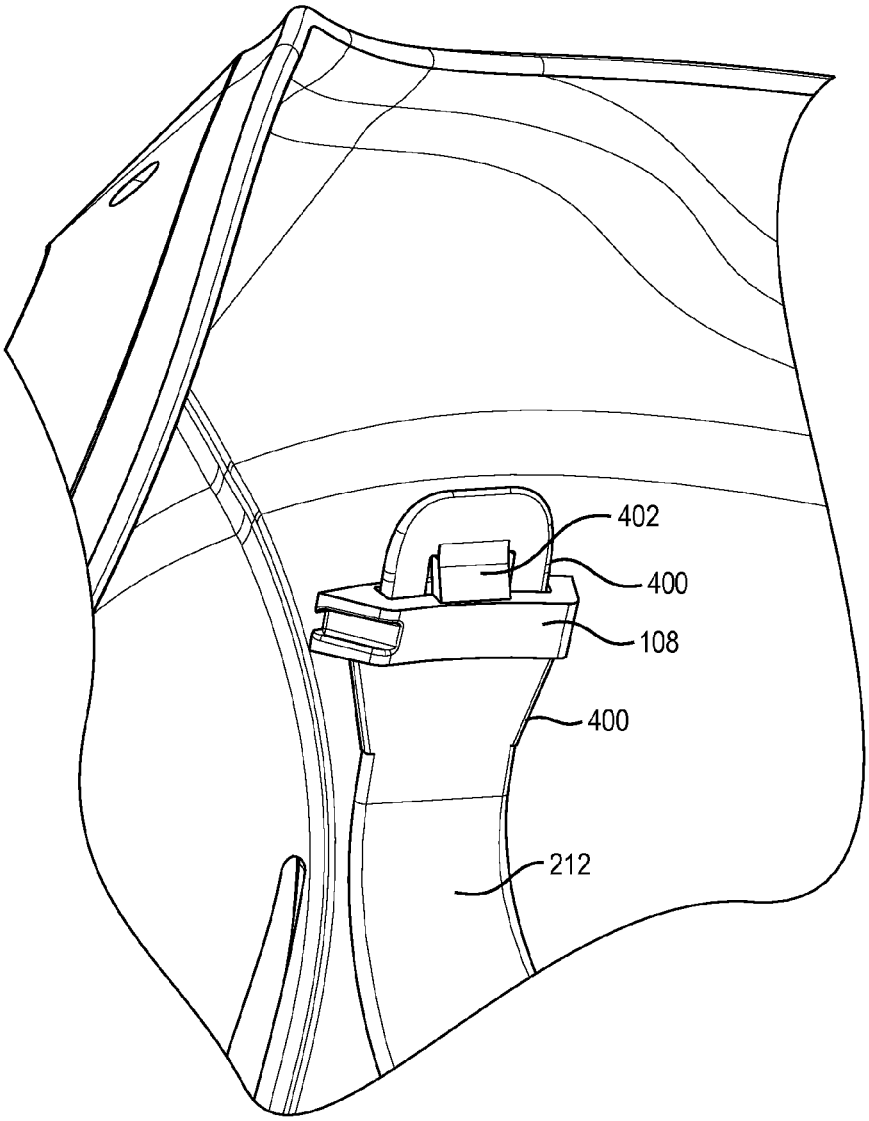
FIG. 5A is a close-up perspective view of an engaged fastener in accordance with one embodiment.
Figure 5B:
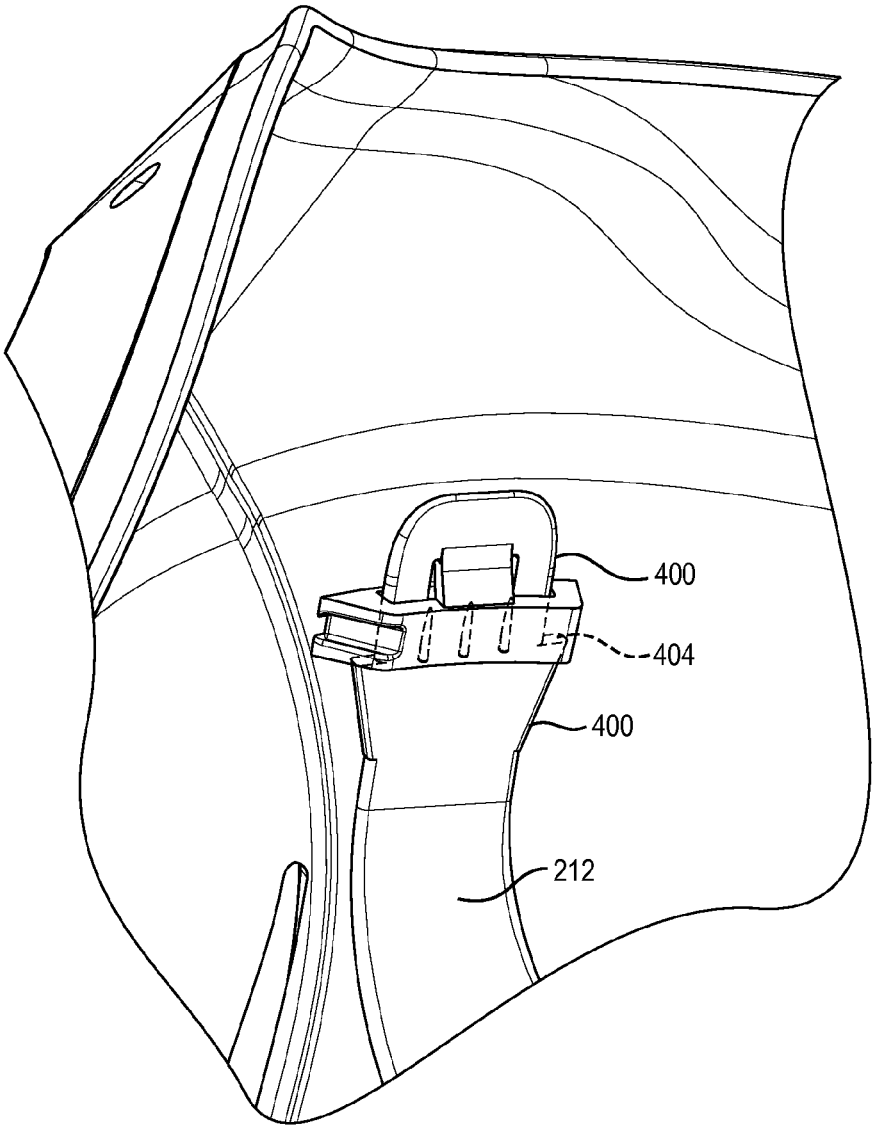
FIG. 5B is a close-up, transparent perspective view of the engaged fastener of FIG. 5A.

FIG. 4 shows a close-up of the fastener 214 and loop-shaped projections 108 of the shell 100 in the unlocked configuration. As illustrated, the fastener 214 includes a slidable tab 400 having thereon a depressable wedge 402. The front portion of the slidable tab 400 has a width w1 that is slightly smaller than the width w2 of the slit 100 (i.e., the inner width of the loop-shaped protection 108), allowing the front portion to be slidably received through the loop 108. Once the front portion has cleared the loop 108, a shoulder 404 of the slidable tab 400 halts further translation of the slidable tab 400 relative to the loop 108 (as illustrated in FIGS. 5A and 5B).

The wedge 402 may be spring-loaded or otherwise mechanically biased towards an extended state, in which the height of the rear edge 406 exceeds the height of the slit 110 with the wedge 402 engaged. The wedge 402 is oriented with its thinner end towards the front of the slidable tab 400, such that, as the fastener 214 passes through the loop 108, the wedge 402 is depressed by the raised bar of the loop 108. Once the wedge 402 has fully cleared the loop 108, it springs back to its extended state, preventing the fastener 214 from sliding back through the loop 108, and thereby locking it in place. FIGS. 5A and 5B illustrate the fastener 214 in this locked configuration. To release the fastener 214, the wedge 402 may be manually depressed, and the tab 400 pulled out of the loop 108.

As will be readily apparent to those of skill in the art, various modifications of the fastener mechanism described above may be used to secure the liner 200 to the shell 100, and may be equally convenient and effective. For example, the wedge 402 may be substituted with two opposed members extending beyond the side walls of the tab 400, and which may be compressed inwardly against bias. As the tab 400 passes through the loop 108, the side walls of the loop 108 compress these opposed members, which spring back out when they have cleared the loop 108, expanding beyond the width w2 and thereby retaining the fastener. Such fasteners are widely used, for example, with backpacks and bags. Other suitable mechanical fasteners are based on clasp, snap, and buckle mechanisms. In general, fastening mechanisms in accordance herewith utilize two complementary, interlocking components, one fixedly attached to or integrated with the liner (herein referred to as the "fastener") and on attached to or integrated with the shell (in the illustrated example, the loop-shaped projection).

Figure 6:
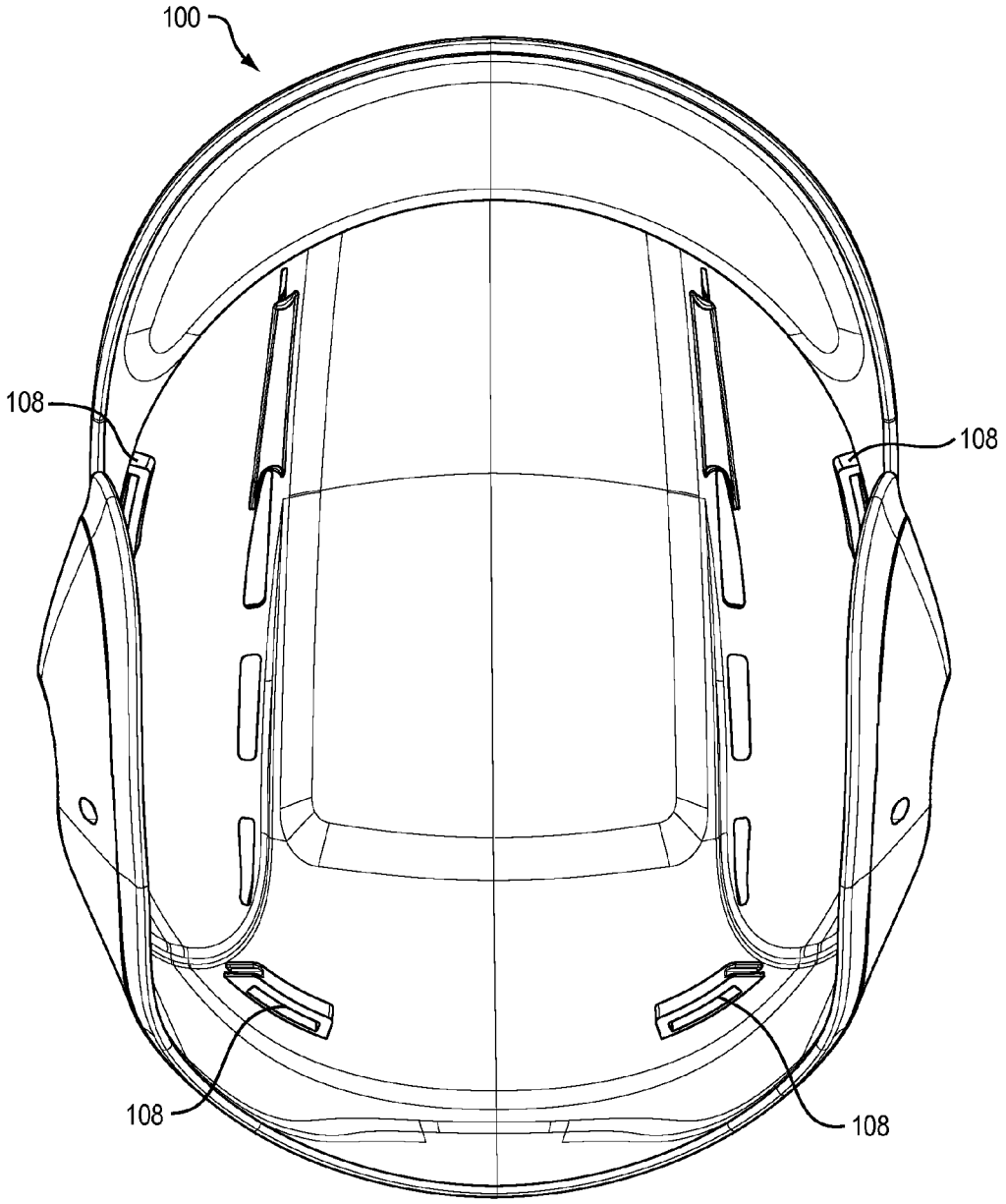
FIG. 6 is an elevation view of the underside of a helmet shell in accordance with one embodiment.

In various embodiments, the fasteners are placed only around a periphery of the liner, and the corresponding features of the shell are, accordingly, only attached around the periphery of the shell. For example, FIG. 6 illustrates the placement of four projection loops 108 along the periphery of the helmet crown 106. Although four fasteners are shown, the optimal number depends on the application; as few as two and as many as six or more fasteners may be employed, for example. Attaching the liner to the shell only around the periphery enables the shell to move independently (within limits) of the liner. This freedom of motion improves protection, in particular, from glancing blows to the head because it reduces the rotational force transferred to the head. In certain embodiments, the fasteners 214 and shell projections 108 are located below the "reference line" of the helmet, which is a horizontal line at or about the level of the wearer's eyebrows below which impacts are unlikely to occur. Placing the fasteners outside the impact area reduces the risk of high impact pressures that might otherwise occur due to impact forces in regions near the fasteners. In addition, it facilitates increasing the thickness of the shock-absorbing layer (e.g., the thickness of the compression cells) and, thus, the ride-down distance of the helmet, as compared with a helmet including an adhesive glue or VELCRO layer (which typically adds between 2 and 2.5 mm to the helmet thickness).

Fasteners in accordance herewith may be used with many types of helmets for various applications. For example, it will be obvious how the fasteners can be implemented in football, hockey, or other sports helmets, as well as in single-impact helmets for bicyclists and motorcyclists, or in construction and military helmets. Further, the shock-absorbing and padding portions of the liner need not be integrated, but may be implemented in separate layers. Moreover, instead of fluidic compression cells, other shock-absorbing mechanisms may be used. For instance, conventional foam pads may be inserted between the shell and the liner. In general, the helmet shape, impact-absorbing mechanism, and other features of the helmet depend on the particular intended use of the helmet. Accordingly, although the present invention has been described with reference to specific details, such details are intended merely for illustration and are not intended to be regarded as limitations upon the scope of the invention.

What is claimed is:

1. A shock-absorbing helmet comprising:

a protective shell having an interior and a plurality of projections disposed on the interior;

a shock-absorbing liner for insertion into the interior of the protective shell; and a plurality of mechanical fasteners coupled to the shock-absorbing liner and configured to releasably lock the liner to the interior of the shell, wherein each of the plurality of mechanical fasteners comprises a slidable tab having thereon a depressible wedge, and wherein each slidable tab is configured to be translated in a first direction away from a crown of the helmet and relative to the plurality of projections as the depressible wedge of each slidable tab is received in each projection.

2. The helmet of claim 1, wherein each of the plurality of mechanical fasteners are engageable by hand into a locked configuration with respect to the interior of the shell and releasable by hand from the locked configuration.

3. The helmet of claim 1, wherein each of the plurality of projections comprises a raised bar protruding from an interior surface of the protective shell toward an inside space of the helmet such that the projection forms a space for receiving the depressible wedge of the slidable tab.

4. The helmet of claim 1, wherein each of the plurality of mechanical fasteners comprise spring-loaded locking fasteners that are slidably received into one of the plurality of projections and locked thereagainst by spring action.

5. The helmet of claim 1, wherein each of the plurality of mechanical fasteners lock the liner to the shell along a peripheral edge thereof.

6. The helmet of claim 1, wherein the depressible wedge extends radially inwardly from the slideable tab away from the interior of the shell.

7. The helmet of claim 1, wherein at least one of the plurality of projections is located below a reference line at the user's eyebrows when the user is wearing the helmet.

8. The helmet of claim 1, wherein the shock-absorbing liner includes straps and each of the plurality of mechanical fasteners is coupled to an end of one of the straps.

9. The helmet of claim 8, wherein the straps include a proximal end coupled to the shock-absorbing liner and a free distal end, wherein the each of the plurality of mechanical fasteners extends distally from a distal end of one of the straps.

10. The helmet of claim 1, wherein each slideable tab includes a shoulder and the depressible wedge is spaced from the shoulder such that the projection is positioned between a rear edge of the depressible wedge and the shoulder when one of the plurality of mechanical fasteners is inserted in one of the plurality of projections.

11. The helmet of claim 1, wherein each of the plurality of projections extend radially inwardly from an inner most surface of the interior.

12. The helmet of claim 1, wherein each slidable tab includes a shoulder and is configured to be translated in the first direction until the shoulder halts further translation of the slidable tab in the first direction.

13. A shock-absorbing liner adapted for releasable affixation into projections disposed on an interior of a helmet shell, the liner comprising:

a plurality of mechanical fasteners integrally formed with the liner in one piece for releasably locking the liner to the interior of the shell, each mechanical fastener comprising a slidable tab having at least one member that is configured to compress as the slidable tab passes through a projection on an interior of a helmet and expand beyond a width of the projection when the at least one member clears the projection, wherein the shock-absorbing liner includes straps, each strap having a proximal end coupled to the shock-absorbing liner and a free distal end, the free distal end of each of the straps being independently moveable with respect to one another, and wherein each of the plurality of mechanical fasteners are coupled to the free distal end of one of the straps and extend away from the strap.

14. The liner of claim 13, wherein each of the plurality of mechanical fasteners are engageable by hand into a locked configuration with respect to the interior of the shell and releasable by hand from the locked configuration.

15. The liner of claim 13, wherein each of the plurality of mechanical fasteners are arranged along a peripheral edge of the liner.

16. The liner of claim 13, wherein each of the plurality of mechanical fasteners and the liner are of unitary construction.

* * * * *